US006053329A

United States Patent [19]

Ballman

[11] Patent Number: 6,053,329

[45] Date of Patent: Apr. 25, 2000

[54] VIBRATORY FRAME MOUNTING STRUCTURE FOR SCREENING MACHINES

[75] Inventor: Brady P. Ballman, Loveland, Ohio

[73] Assignee: Rotex, Inc, Cincinnati, Ohio

[21] Appl. No.: 09/059,775

[22] Filed: Apr. 14, 1998

[51] Int. Cl.[7] ..... B07B 1/49

[52] U.S. Cl. ..... 209/405; 209/411; 209/412

[58] Field of Search ..... 209/309, 327, 209/333, 409, 405, 408, 334, 404, 372, 412, 413

[56] References Cited

U.S. PATENT DOCUMENTS

| | | | |
|---|---|---|---|
| 166,680 | 8/1875 | Bond | 209/372 |
| 2,114,406 | 4/1938 | Simpson . | |
| 3,081,874 | 3/1963 | Corbin et al. . | |
| 3,169,475 | 2/1965 | Caouette | 209/408 |
| 3,386,580 | 6/1968 | Grabarczyk | 209/408 |
| 3,390,771 | 7/1968 | Wehner | 209/408 |
| 3,433,357 | 3/1969 | Nolte | 209/372 |
| 3,928,189 | 12/1975 | Lower et al. . | |
| 3,980,555 | 9/1976 | Freissle | 209/408 |
| 4,141,821 | 2/1979 | Wolff | 209/405 |
| 4,219,412 | 8/1980 | Hassall | 209/408 |
| 4,347,129 | 8/1982 | Rutherford | 209/408 |
| 4,482,455 | 11/1984 | Humphrey | 209/405 |
| 4,582,597 | 4/1986 | Huber | 209/403 |
| 5,006,228 | 4/1991 | Anderson et al. | 209/365.3 |
| 5,137,622 | 8/1992 | Souter | 209/408 |
| 5,248,043 | 9/1993 | Dorn | 209/399 |
| 5,332,101 | 7/1994 | Bakula | 209/403 |
| 5,392,925 | 2/1995 | Seyffert | 209/405 |
| 5,464,101 | 11/1995 | Freissle | 209/412 |
| 5,735,409 | 4/1998 | Malmberg | 209/399 |
| 5,927,511 | 7/1999 | Riddle et al. | 209/405 |
| 5,951,864 | 9/1999 | Hazrati et al. | 210/388 |
| 5,960,962 | 10/1999 | Ljokkoi | 209/273 |

FOREIGN PATENT DOCUMENTS

| | | | |
|---|---|---|---|
| 189038 | 2/1957 | Germany | 209/408 |
| 1186311 | 1/1965 | Germany . | |
| 543 | of 1895 | United Kingdom | 209/372 |
| 2059807 | 4/1981 | United Kingdom | 209/408 |

*Primary Examiner*—Donald P. Walsh
*Assistant Examiner*—Daniel K Schlak
*Attorney, Agent, or Firm*—Wood, Herron & Evans

[57] ABSTRACT

A mounting structure for a screen frame and/or a top cover to a vibratory frame of a screening machine requires only an initial one time adjustment and includes a pair of elastomeric restraints each including a compressible bumpers on a head-end of the screen frame or top cover and a pair of compressible rollers on a foot-end of the screen frame or top cover. The screening machine mounting structure accounts for the manufacturing tolerances between the screen frame or top cover and the vibratory box frame to provide a snug fit. The rollers allow for easy screen frame or top cover installation and removal and prevent metal-to-metal contact between the respective components which generates wear and noise during operation. Further, the mounting structure according to this invention can be retrofittable into existing screening machines as well as being original equipment and is useful for securing other components of the screening machine in addition to the screen frame and top cover.

35 Claims, 4 Drawing Sheets

VIBRATORY FRAME MOUNTING STRUCTURE FOR SCREENING MACHINES

BACKGROUND OF THE INVENTION

This invention relates to screening machines of the type used to separate or classify mixtures of solid particles of different particle sizes into classes of different sizes. The invention also relates to screening machines of the type used for liquid/solid separations, i.e., for separating solid particles of specific sizes from a liquid in which they are carried. More particularly, the invention relates to a structure for mounting components to a vibratory frame of such machines.

In screening machines of the type described, a screen (which may be woven, an aperture plate or another design) is mounted in what is often called a "screen frame" or "screen deck" which includes a supporting peripheral frame or edge around the perimeter of the screen. Typically associated with this screen frame are other material handling elements which are moved with the screen frame and form walls or partitions above or below the screen for containing the liquid and/or particulate materials adjacent to the screen and directing them to appropriate outlets. These elements may comprise a top cover and a pan beneath the screen frame. In the case of multiple deck units, spacer pans or frames are provided between multiple screens. A seal is often provided between the adjacent screen frames to prevent the escape of material from between the screen frames.

The screen frames are often removed from the screening machines for cleaning, replacement, readjustment or installation of a screen of a different mesh size or the like. The top cover and screen frame are each releasably mounted or secured to a frame, table or box to which vibratory motion is imparted, typically by one or more eccentric rotors or other means of vibratory excitation. The frame, table or box is referred to herein as a "vibratory frame". The frame, table or box may be moved in oscillatory, vibratory, gyratory, gyratory reciprocating, fully gyratory, rotary or another type of motion (herein collectively referred to as "vibratory" motion or variations of that term). The vibratory motion of the vibratory frame is typically two-dimensional (i.e., the motion is contained within a plane). The screen assembly is releasably secured to the vibratory frame so that it can be removed for cleaning, change or replacement and also for ease of access to the vibratory drive. Likewise, the top cover is releasably secured by clamps to the vibratory frame to cover the screen frame.

In enlarged commercial screening machines, the weight of the top cover itself or of the screen assembly carried by the vibratory frame, and the weight of the material being processed on it, may total several hundred pounds or more. This presents a very substantial inertial mass which resists the changes of motion applied thereto by the vibratory drive acting through the vibratory frame. As a result of these inertial forces, a relative motion may exist between the vibratory frame and the screening frame or the top cover. Typically, the top cover, screen frame and vibratory frame are each constructed of metal which could result in significant noise, wear or damage due to the relative motion or rubbing action. Reducing the metal-to-metal contact minimizes the wear on the various metal components and the noise associated with the operation of the screening machine. The resulting impact forces between the screen frame or top cover and vibratory frame, which are typically limited to or contained in the two-dimensional plane of the movement of the vibratory frame, would significantly increase the stresses on the components and reduce their useful life.

Screen frame movement is typical because the manufacturing tolerances for many screen frames allow for a ⅜" longitudinal and a ½" lateral size difference with respect to the vibratory box frame. Movement of the screen frame and top cover must be minimized to reduce possible wear to these components from the motion of the screen frames. The screen frame and top cover must be secured to the vibratory frame sufficiently such that they essentially follow the vibratory motion of the vibratory frame with rubbing or knocking.

Various devices are known for securing the screen frames to the vibratory frames. One known device for this purpose is disclosed in U.S. Pat. No. 2,114,406 in which a screen deck is clamped against a frame in the form of a box. Movement of the screen frame relative to the vibratory frame is positively prevented by jack screws, commonly called "sieve jacks", which are mounted in the vibratory frame and are set up to bear against a vertical sidewall of the screen frame so that the frame is held in a rigidly fixed position in the vibratory frame. The sieve jacks have proven helpful to reduce the wear of the seals between the adjacent screen frames and to minimize metal-to-metal contact between the screen frames and the vibratory box frame. Sieve jacks are basically threaded rods that penetrate through the screening machine and push the screen frames toward the opposite end of the screening machine to take up the gap from the manufacturing tolerances associated with the screen frames and the vibratory frames.

However, the use of sieve jacks as described has proven to be problematic in many respects. For example, the material being classified or screened in the screening machine often contaminates or fowls the threads of the sieve jacks thereby causing the sieve jacks to bind and resist adjustment or rotation. Additionally, sieve jacks are often used incorrectly so that they are insufficiently tightened to resist screen frame motion, noise and seal wear. Alternatively, many sieve jacks are operated after being overly tightened by the user which may result in screen frame damage, poor sealing between the adjacent screen frames and additional stress to the components. Some of these problems are partly due to the fact that a user cannot visually inspect whether the sieve jacks are engaged with the screen frame after adjustment. Further, a separate tool such as a wrench or the like is required to properly secure the sieve jacks so they do not work themselves loose during operation of the screening machine.

Moreover, the sieve jacks often do not adequately position the screen frames relative to one another due partly to the fact that the user cannot visually inspect the engagement of the sieve jacks. As a result, stack up or alignment problems of the various screen decks is often undetected prior to operation of the screening machine. Therefore, the seals on the adjacent screen frames are misaligned allowing for leakage of the material. Additionally, the sieve jacks are often damaged and require replacement and are considered to be a relatively expensive item.

The top cover has also been known to shift during operation of particularly large commercial screening machines despite the use of multiple, oftentimes 16–20 in number, clamps. As a result, the top cover has heretofore been bolted directly to the box frame to resist movement in the horizontal plane. Even with the use of additional bolts, the clamps are required to maintain downward pressure on the cover which is transmitted downwardly to ensure sealing contact between the adjacent screen frames.

However, the use of bolts is very time consuming for the operators when securing or removing the top cover.

Additionally, the integrity of the cover is compromised when the cover is modified to accommodate the bolt which may lead to the escape of particulate material from the screening machine or contamination thereof.

SUMMARY OF THE INVENTION

A new mounting structure for securing components to a vibratory frame in a screening machine overcomes the identified problems with sieve jacks, bolts and other known mounting structures, as well as offering advantages heretofore unrealized for screening machines. A mounting structure according to a presently preferred embodiment of the invention releasably mounts or secures a screen frame, top cover or other component to the vibratory frame of the screening machine.

Screen frames are typically rectangular and extend around the periphery of a screen. The screen frame must be selectively coupled to the vibratory frame of a screening machine so that the vibratory motion is transferred to the screen assembly. The top cover also must be selectively coupled to the vibratory frame to contain the material being screened and inhibit contamination. The mounting structure according to a presently preferred embodiment of this invention includes a pair of rollers mounted on a first end of the screen frame or top cover and a pair of fixed elastomeric restraints mounted to an opposite second end of the screen frame or top cover. The rollers and elastomeric restraints each project from a perimeter edge of the screen frame or top cover to contact the vibratory box frame. Advantageously, the axis of rotation of the rollers is parallel to the plane of vibration of the screening machine. As such, the rollers are easily coupled to the vibratory frame via a "rolling wedge" action while resisting the movement of the frame once installed.

Preferably, the rollers and elastomeric restraints each include a compressible polymeric material to form a compression fit between the screen frame or top cover and the vibratory frame. Additionally, the position of the elastomeric restraints and to a lesser extent of the rollers relative to the screen frame or top cover are adjustable prior to installing the screen frame or top cover into the vibratory frame to ensure a proper and snug fit.

The mounting structure according to this invention provides a snug fit while taking up the manufacturing tolerances which are ever-present. The rollers allow easy screen frame or top cover installation and removal from the vibratory frame and act as a bumper to avoid noise and metal-to-metal contact between the screen frame or top cover and vibratory frame and as a restraint to convey motion. Once the position of the rollers is set by the manufacturer, no adjustment by the user is required; however, adjustment can be easily accomplished of the elastomeric restraints by the user, if required. The mounting structure according to this invention is significantly cheaper than sieve jacks and does not require replacement as frequently. The design is simple, and robust and permits correct seal alignment between the adjacent screen frames. The vibratory frame and top cover are not penetrated so as to maintain the integrity of these components and inhibit the escape of material being screened. The rollers and elastomeric restraints avoid the problem of the threads on the sieve jacks or top cover bolts being fouled by the material in the screening machine and needing readjustment each time. Further, the mounting structure according to this invention can be easily retrofit into existing screening machines currently in use.

BRIEF DESCRIPTION OF THE DRAWINGS

The objectives and features of the invention will become more readily apparent from the following detailed description taken in conjunction with the accompanying drawings in which.

DETAILED DESCRIPTION OF THE INVENTION

Figure 1:
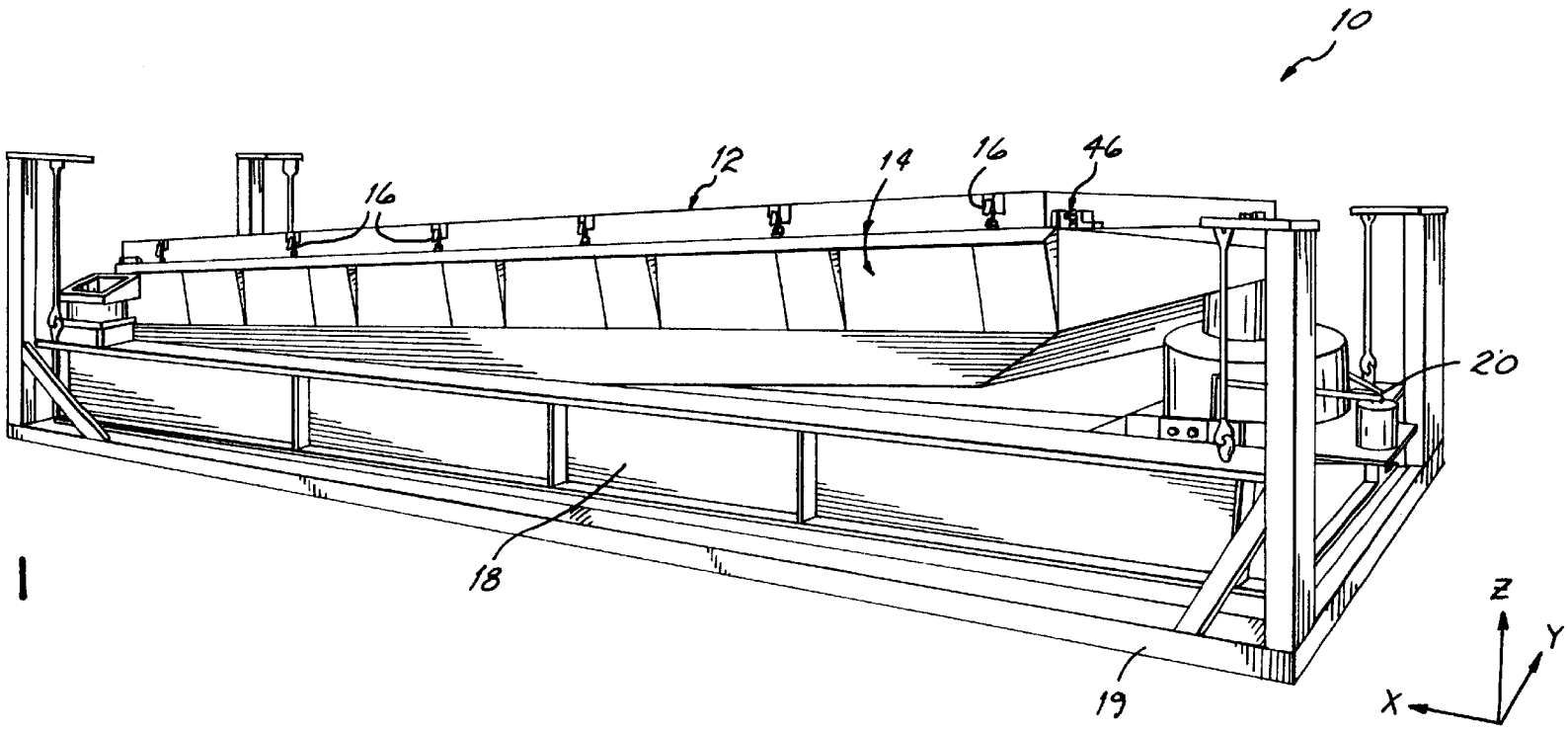
FIG. 1 is a perspective view of an exemplary screening machine.

Referring to FIG. 1, an embodiment of a screening machine 10 in which the present invention may be used is shown. The screening machine 10 includes a top cover 12 which is clamped via a series of clamps 16 onto a vibratory box frame 14 of the screening machine 10. Screening machines 10 of this general type are sold commercially, one example being the "Rotex" screeners made and sold by the assignee of this invention, Rotex, Inc., of Cincinnati, Ohio. One example of a presently preferred embodiment of a clamp for this purpose is disclosed in U.S. patent application Ser. No. 08/958,904, filed Oct. 28, 1997, assigned to the assignee of the present invention and hereby expressly incorporated by reference in its entirety.

The screening machine 10 includes a base 18, and optionally a cable support stand 19 in combination with the base 18. At its upper end or head end, the frame 14 is driven by an electric motor (not shown) through an eccentric, vibratory or other screening motion creating drive 20 which imparts an oscillatory, vibratory, gyratory, gyratory reciprocating, fully gyratory, rotary or other motion (herein collectively referred to as "vibratory" motion or variations of that term) to the screen box 14. Specifically, the drive 20 imparts vibratory motion to the frame 14 in two dimensions or planar. In other words, the vibratory motion is primarily contained in the X-Y direction and does not have a significant Z-direction component.

Figure 2:
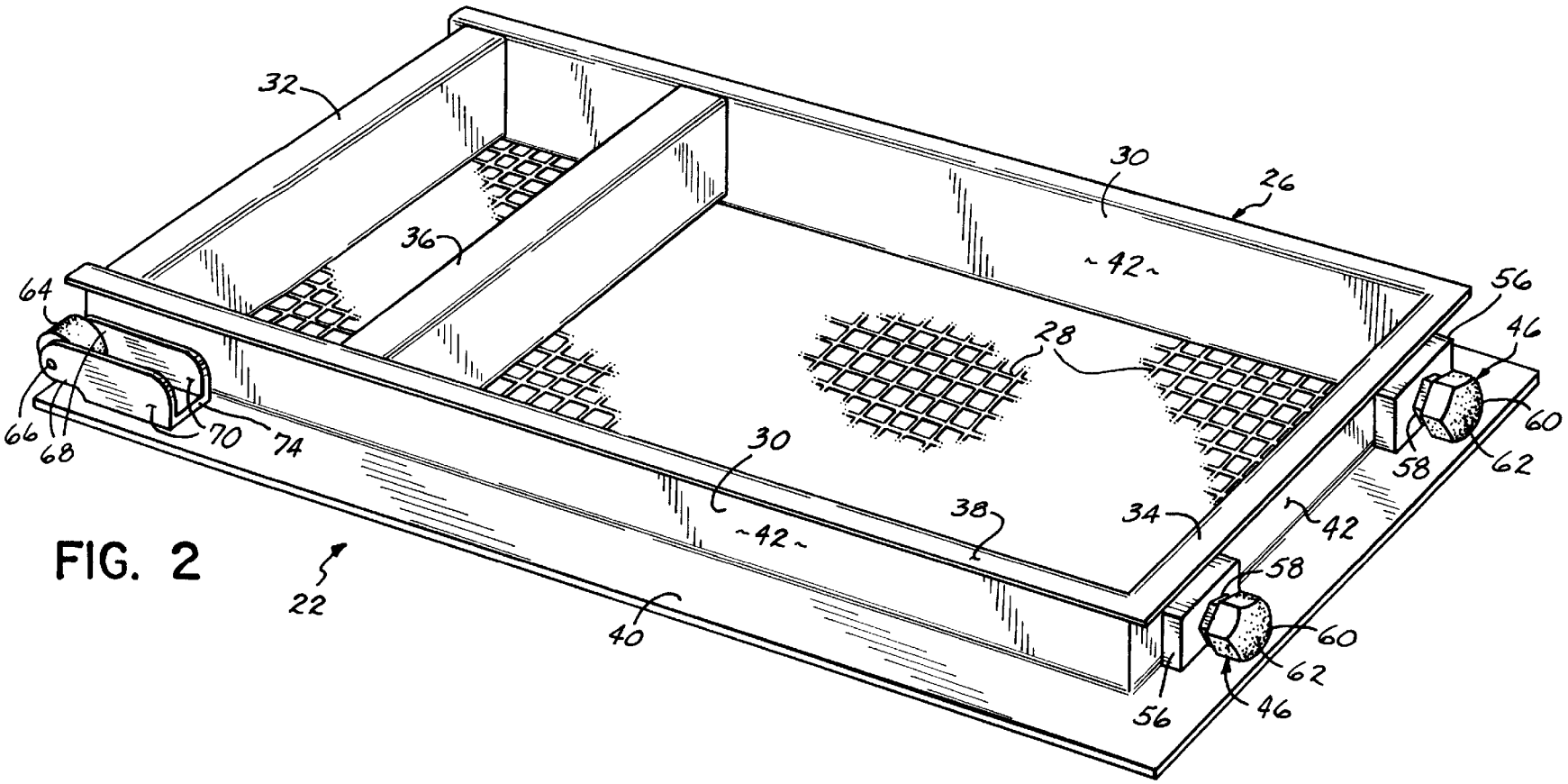
FIG. 2 is a perspective view of a screen frame and mounting structure therefor according to a presently preferred embodiment of this invention.
Figure 3:
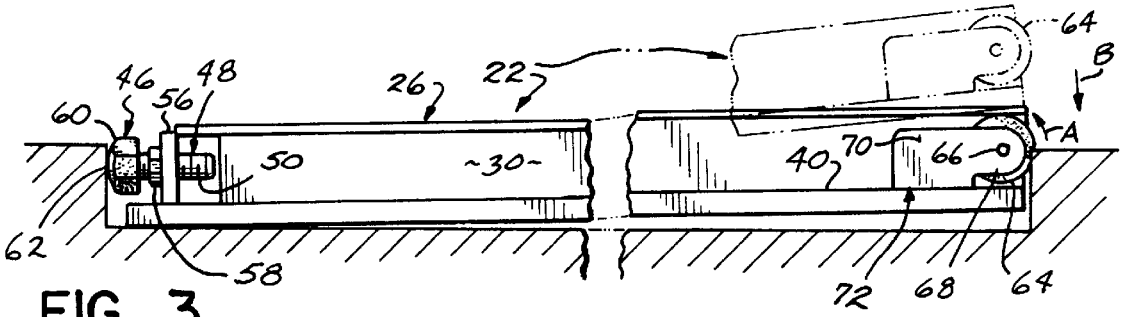
FIG. 3 is a schematic cross-sectional view of the screen frame of FIG. 2 being installed into a vibratory frame of the screening machine.
Figure 4:
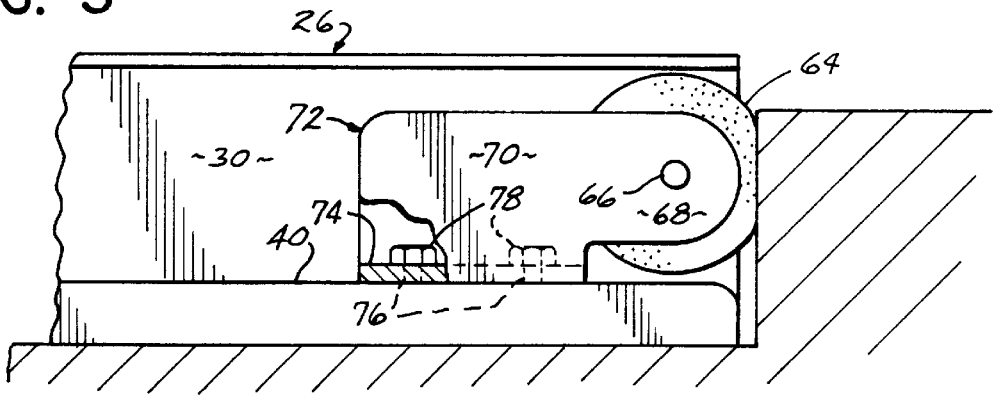
FIG. 4 is an enlarged view of a portion of the screen frame and the roller mounted thereon being compressed after being mounted into the vibratory frame of the screening machine.

Within the frame 14 of the screening machine 10, one or more screen assemblies 22, as shown in FIGS. 2–4 are releasably secured to the vibratory box frame 14 of the screening machine 10. Referring particularly to FIG. 2, the screen assembly 22 includes, in a presently preferred embodiment, a generally rectangular screen frame 26 surrounding the perimeter of a screen 28. The screen frame 26 includes a pair of spaced side frame members 30, 30 and a foot-end frame member 32 at an opposite end of a head-end frame member 34 separating the side frame members 30, 30. Additionally, a lateral spar 36 may be included which extends generally parallel to the end frame members 32, 34 between the side frame members 30, 30. The spar 36 frequently must be aligned with corresponding structure on adjacent screen assemblies 22 to provide a seal therebetween.

Figure 5C:
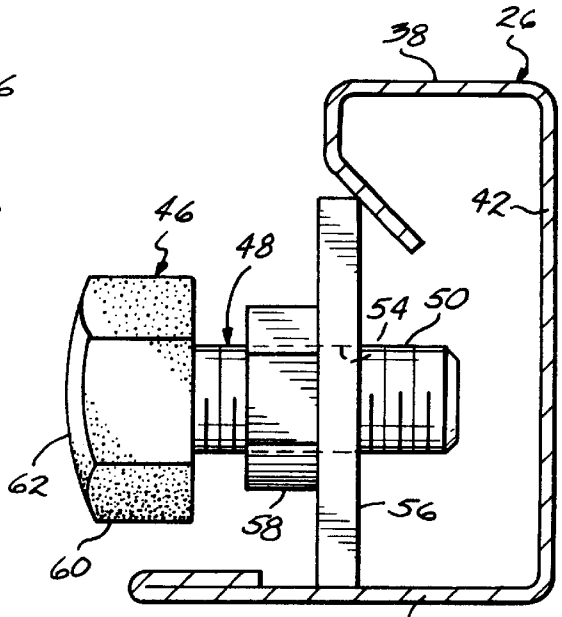
FIGS. 5A–5C are various embodiments of the elastomeric restraints used as part of the mounting structure and various screen frame designs according to presently preferred embodiments of this invention.
Figure 5B:
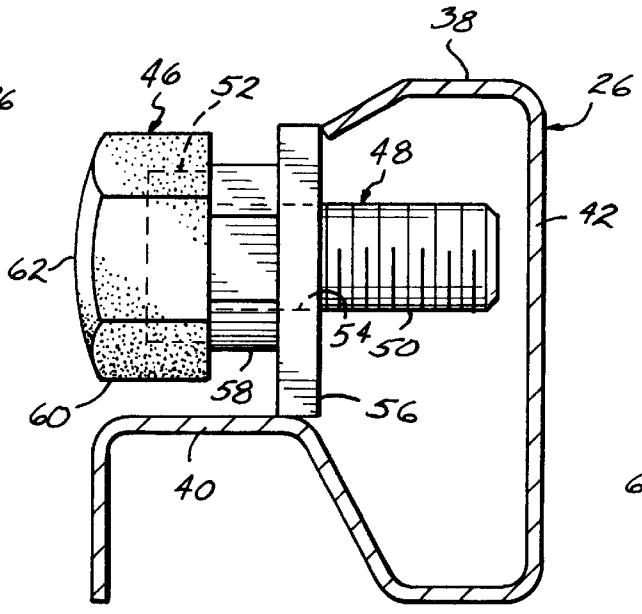
Figure 5A:
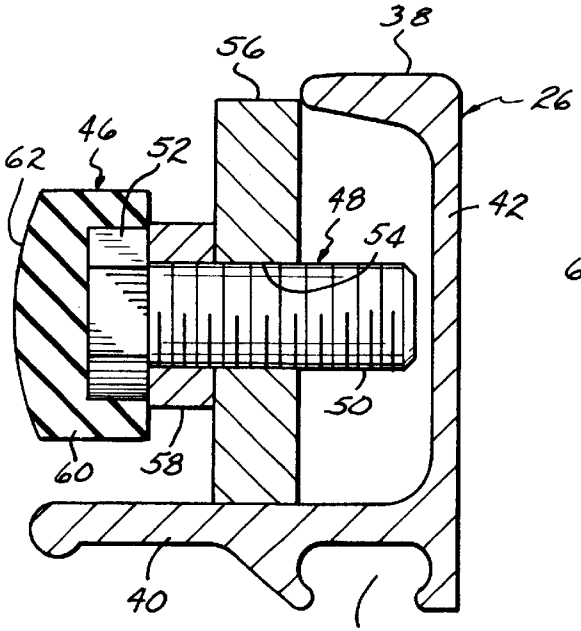

The side frame members 30, 30 and head-end frame member 34 each include an upper rim 38 which is generally parallel to and spaced from a lower flange 40. Examples of alternative embodiments of these frame members are shown in cross section in FIGS. 5A–5C. The screen frame 26 may be extruded from aluminum as shown in FIG. 5A or steel as shown in Fig. 5B and 5C. The width of the flange 40 is greater than the width of the rim 38 so that the outer perimeter of the flange 40 extends beyond the outer perimeter of the rim 38. A generally perpendicular web 42 connects an inner edge of the rim 38 to an inner edge of the flange 40. The frame members 30, 32, 34, 36 may include a seal receiving pocket 44 for a seal (not shown) as in FIG. 5A. In a presently preferred embodiment, the foot-end frame member 32 and the spar 36 are each generally rectangular box-shaped frame members.

A pair of elastomeric restraints 46 as part of the structure for mounting the screen frame 26 to the vibratory box frame 14 are mounted to the head-end frame member 34 and are spaced relative to one another. The elastomeric restraints 46 include a standard bolt 48 having a threaded stem 50 projecting from a head 52 of the bolt 48. In a preferred embodiment, the bolt 48 is a grade 5, stainless steel, ½" fine (20) by 1 ¼". The threaded stem 50 of the bolt 48 is seated in a threaded aperture 54 of a bumper mounting block 56 which is welded or otherwise secured to the screen frame 26 (FIGS. 5A–5C). Preferably, a jam nut, locking nut 58 or the like is positioned on the threaded stem 50 between the head 52 of the bolt 48 and the mounting block 56 to inhibit rotation of the elastomeric restraint 46 in the aperture 54. Preferably, the mounting block 56 is aluminum or steal and is welded at its upper end and lower end to the rim 38 and flange 40 of the screen frame 26, as shown particularly in FIGS. 5A–5C.

Preferably, the head 52 of the elastomeric restraint 46 is hexagonal and includes a molded 75 A Durometer, FDA approved neoprene bumper 60 thereon. The bumper 60 may have a higher Durometer characteristic, for example on the order of 85–90 A Durometer. Preferably, the bumper 60 is 0.13" thick on the side faces of the head 52 of the bolt 48 and extends 0.32" from the upper surface of the head 52 of the bolt 48 of which 0.13" is an arcuate crown portion 62 of the molded bumper 60. The dome-shaped crown 62 on the bumper 60 of the elastomeric restraint 46 aids the installation of the screen frame 26 into the vibratory frame 14 as will be described later herein. The elastomeric restraint 46 extends on the order of 1/16" to ⅛" or more from the outer edge of the head-end of the screen frame 26. Clearance of approximately 5/16" is preferably provided for access to the jam nut 58 so that a open ended wrench or the like can be inserted between the bumper 60 and the mounting block 56 or upper rim 38 of the screen frame 26 for adjustment of the elastomeric restraint 46. The head 52 of the bolt 48 is preferably hexagonal as is the bumper 60 applied thereto for rotation of the elastomeric restraint 46 relative to the mounting block 56.

A pair of rollers 64 are also part of the mounting structure and are mounted proximate the foot-end of the screen frame 26 as shown particularly in FIGS. 2–4. Each roller 64 is approximately 11/16" in width and has a diameter of 1 3/16". The roller 64 is preferably 75 A Durometer, FDA approved neoprene and includes a stainless, seamless bushing (not shown) on an inner circumference thereof. The roller 64 may have a higher Durometer characteristic, for example on the order of 85–90 A Durometer. The bushing is preferably ½" outer diameter, 13 gauge 0.31" inner diameter and is 11/16" in length. Each roller 64 is mounted for rotation on a shaft 66 extending between arms 68 projecting from the spaced sidewalls 70 of a generally U-shaped roller support 72. Preferably, a snap ring (not shown) on the end of the shaft is used to secure the shaft 66 extending through the roller 64 and mount the roller 64 to the arms 68 projecting from the respective sidewalls 70 of the roller support 72. The sidewalls 70 are joined together by a lower base 74 which preferably has two apertures 76 therethrough for the insertion of two mechanical fasteners 78 such as screws, bolts or the like to secure the roller support 72 to the flange 40 of the side frame members 30 proximate the foot-end of the screen frame 26. A plurality of holes or apertures may be provided in the flange 40 for adjustability of the position of the roller 64 on the screen frame 26. In a presently preferred embodiment of the invention, the position of the rollers 64 and the roller support 72 are selected by the manufacturer; however, it will be appreciated that the position is adjustable by the user as may be required for particular installations.

Preferably, the leading edge of the roller 64 projects at a ⅛" to 3/16" overhang relative to the foot-end of the screen frame 26. Additionally, the lower edge of the roller 64 is spaced from the upper surface of the flange 40 to allow for deformation of the roller 64 when the screen frame 26 is installed into the vibratory frame 14 of the screening machine 10 (FIG. 4). The particular material chosen for the rollers 64 and the bumpers 60 is preferably polymeric and must not be too hard to avoid compression set of the components during prolonged use in the screening machine 10 nor be too soft to allow movement of the screen frame 26 relative to the vibratory frame 14 during use. The bushing and the roller 64 advantageously assists to avoid compression set and provide a rolling contact surface with the shaft 66. Furthermore, neoprene is advantageously used for the bumpers 60 and the rollers 64 because it maintains its integrity at operating environments up to 250° F. The roller 64 is elastomeric so it does deform somewhat under load to act like a relatively stiff spring between the vibratory frame 14 and the screen frame 26. The roller 64 accommodates for the gap between the screen frame 26 and the vibratory frame 14 and the associated manufacturing tolerances and allows for easy installation and removal due to the rolling wedge action it provides. It will be appreciated that the compressible roller 64 may be replaced with a rotational element of another design coupled to a damper, spring or the like within the scope of this invention.

The installation of the screen frame 26 into the vibratory frame 14 is particularly shown in FIGS. 3 and 4 and is initiated by positioning the head-end of the screen frame 26 into the vibratory frame 14 so that the crowns 62 of the elastomeric restraints 46 are in contact with an exposed surface of the vibratory box frame 14 as shown in FIG. 3. The foot-end of the screen frame 26 is then pivoted downwardly so that the rollers 64 initially contact an upper corner of the vibratory box frame and begin to compress and roll in the direction of arrow A in FIG. 3. The action of the rollers 64 during installation of the screen frame 26 is that of a rolling wedge so that continued downward force in the direction of arrow B of FIG. 3 on the screen frame 26 continues to roll and compress the rollers 64 until the screen frame 26 is seated in the vibratory frame 14 as shown in FIG. 4. With the screen frame 26 installed into the vibratory box frame 14, a compression friction fit is provided by the elastomeric restraints 46 and rollers 64 on the screen frame 26. The rollers 64 advantageously provide a reduced friction installation of the screen frame 26 while offering a secure coupling to the vibratory frame 14 when installed. While the rollers and elastomeric restraints are presently preferred embodiments of mounts for securing the frames relative to one another, other types of mounts could be used with this invention.

Preferably, the head-end and foot-end of the screen frame 26 do not contact the adjacent respective surfaces of the vibratory box frame 14 to avoid metal-to-metal contact, wear and the noise associated therewith during operation of the screening machine 10. The bumpers 60 and rollers 64 are compressed when the screen frame 26 is installed into the vibratory frame 14 to provide a secure friction and compression fit. The configuration of the crown 62 on the bumpers 60 assists in the installation of the screen frame 26 to maintain bumper 60 contact with the vibratory frame 14 as the foot-end of the screen frame 26 is pivoted downwardly into position as shown in FIGS. 3 and 4.

In a presently preferred embodiment of the invention, the position of the rollers 64 are fixed on the screen frame 26 and any adjustments required to align the spars, seals or the like of the respective screen frames 26 can be accomplished by the rotation of the elastomeric restraint 46.

Figure 6:
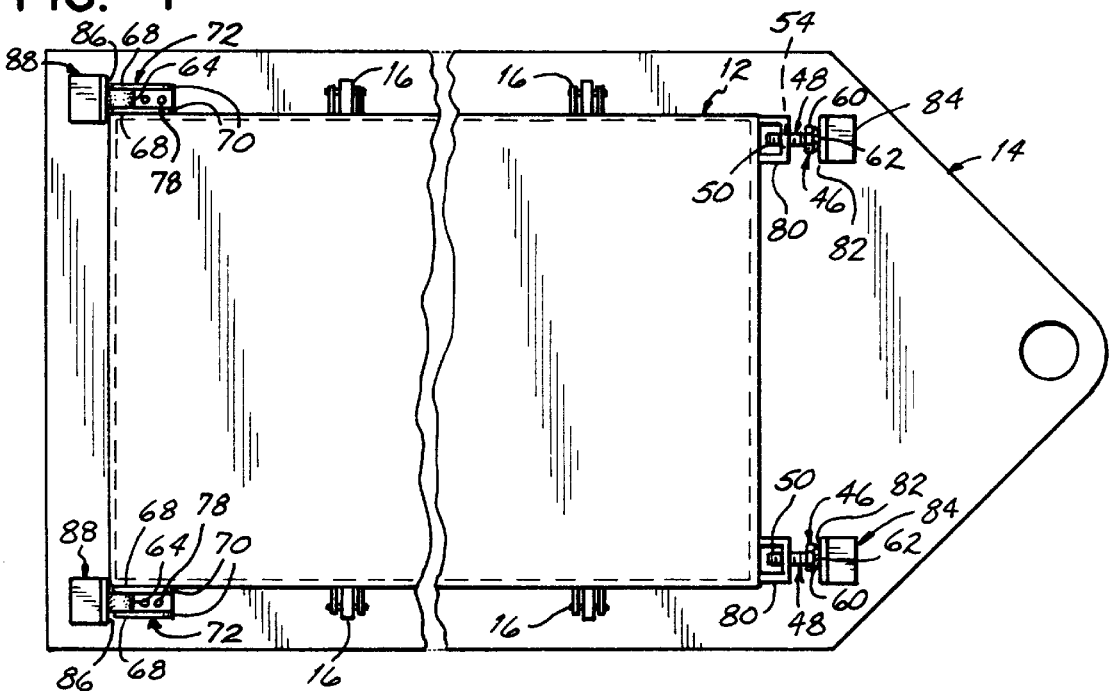
FIG. 6 is a top plan view of a presently preferred mounting structure for the top cover according to this invention.
Figure 7:
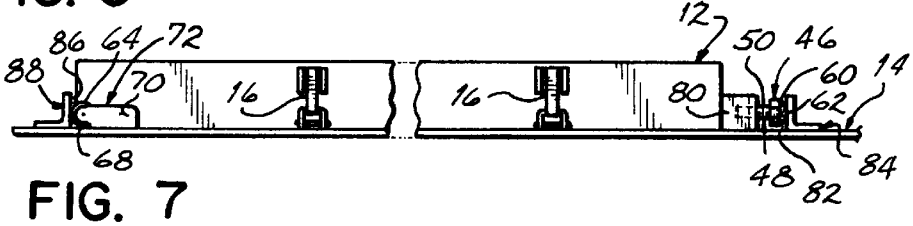
FIG. 7 is a side elevational view of the mounting structure of FIG. 6.

Another presently preferred embodiment of the mounting structure according to this invention is shown in FIGS. 6–7 in which components similar to those of the embodiments shown in FIGS. 2–5C are identified with the same reference numeral. Specifically, the mounting structure is used for securing the top cover 12 to the vibratory box frame 14. The mounting structure as shown in FIGS. 6–7 includes a pair of spaced elastomeric restraints 46 in which the stem 50 of the bolt 48 engages a threaded aperture 54 in a generally U-shaped mounting block 80 which is welded or otherwise secured to the cover 12. The bolt 48 could be rotated relative to the mounting block 80 to adjust the position of the elastomeric restraint 46. The elastomeric restraint 46 contacts a face 82 of a generally L-shaped angle mount 84 which is welded or otherwise secured to the top cover 12 as shown in FIGS. 6–7.

Additionally, a pair of rollers 64 are each mounted in a roller support 72 proximate an opposite end of the top cover 12 from the elastomeric restraints 46. The outer circumference of each of the rollers 64 contacts a face 86 of a generally L-shaped angle mount 88 which is welded or otherwise secured to the vibratory frame 14. Unlike the mounting of the roller support 72 on the screen frame 26, the roller support 72 on the top cover 12 may be welded, bolted or otherwise secured to a generally vertical sidewall of the top cover 12 with the adjacent sidewall 70 of the roller support 72. Once again, the axis of rotation of the rollers 64 is generally parallel to the plane of vibration of the vibratory frame 14 so that during installation of the top cover 12, the rolling wedge action of the rollers 64 on the angle mounts 88 effectuates a compression friction fit in combination with the elastomeric restraints 46 on the angle mounts 84. Preferably, the mounting structure for the top cover 12 resists the vibratory motion to secure the top cover 12 relative to the vibratory frame 14 while the plurality of clamps 16 are also used to secure the top cover 12 to the screening machine 10. The clamps 16 are particularly beneficial to provide downward pressure on the screen frames 26 to maintain sealing contact between the adjacent screen frames 26 and the like. Advantageously, the mounting structure shown in FIGS. 6–7 does not require bolting through the top cover 12 and, as a result, maintains the integrity of the top cover 12 to inhibit escape of screening material from the screening machine 10 or the introduction of contaminants therein.

From the above disclosure of the general principles of the present invention and the preceding detailed description of a preferred embodiment, those skilled in the art will readily comprehend the various modifications to which this invention is susceptible. For example, the mounting structure, including the elastomeric restraints and rollers could be used to secure other components of the screening machine relative to one another. Additionally, the elastomeric restraints and/or rollers could be mounted on the vibratory frame to engage the screen frame. Moreover, other models, designs or configurations of screening machines and screen frames (i.e., non-rectangular screens) would benefit from this invention. The invention provides for an interference, compression or friction fit between a component of the screening machine and the vibratory frame which avoids friction problems during installation of the component while still transmitting or conveying the vibratory motion from the vibratory frame to the installed component . Therefore, I desire to be limited only by the scope of the following claims and equivalents thereof.

I claim:

1. A screening machine comprising:

a base;

a vibratory frame mounted to the base for vibratory motion with respect to the base;

a vibratory drive operatively coupled to the vibratory frame for imparting vibratory motion to the vibratory frame;

a screening machine component being selectively coupled to the vibratory frame so that the vibratory motion is transmitted to the screening machine component; and a screening machine component mounting structure including a first mount proximate a first end of the screening machine component and a second mount proximate a second end of the screening machine component opposite from the first end, each of the mounts being positioned between a portion of the screening machine component and a portion of the vibratory frame and at least one of the first and second mounts being compressible to form a compression fit between the screening machine component and the vibratory frame;

wherein the first and second mounts are mounted to the screening machine component and the compressible mount comprises a roller mounted for rotation on the screening machine component, the roller being rotatable and compressible during installation of the screening machine component to the vibratory frame.

2. The screening machine of claim 1 wherein the screening machine component is generally rectangular, the mounting structure further comprising:

a third mount mounted on the first end of the screening machine component and spaced from the first mount and a fourth mount mounted on the second end of the screening machine component and spaced from the second mount.

3. The screening machine of claim 1 wherein both the first and second mounts are compressible and comprise a polymeric material.

4. The screening machine of claim 3 wherein the first mount comprises a roller mounted for rotation on the screening machine component, the roller being rotatable and both the roller and the second mount being compressible during installation of the screening machine component to the vibratory frame.

5. The screening machine of claim 4 wherein the respective positions of the roller and of the second mount are adjustable relative to the screening machine component prior to installation of the screen assembly to the vibratory frame.

6. The screening machine of claim 1 wherein a portion of the roller projects from a perimeter of the screening machine component and the screening machine component does not contact the vibratory frame when installed therein.

7. The screening machine of claim 1 wherein the screening machine component is selected from one of the following group comprising a screen frame assembly and a top cover.

8. The screening machine of claim 1 wherein the first and second mounts are mounted to the vibratory frame.

9. A screening machine comprising:

a base:

a vibratory frame mounted to the base for vibratory motion with respect to the base;

a vibratory drive operatively coupled to the vibratory frame for imparting vibratory motion to the vibratory frame;

a screening machine component being selectively coupled to the vibratory frame so that the vibratory motion is transmitted to the screening machine component; and a screening machine component mounting structure including a first mount proximate a first end of the screening machine component and a second mount proximate a second end of the screening machine component opposite from the first end, each of the mounts being positioned between a portion of the screening machine component and a portion of the vibratory frame and at least one of the first and second mounts being compressible to form a compression fit between the screening machine component and the vibratory frame;

wherein the vibratory motion generated by the vibratory drive is generally within a plane and the first mount further comprises a rotational element mounted for rotation about an axis generally parallel to the plane of the vibratory motion.

10. A screening machine comprising:

a base;

a vibratory frame mounted to the base for vibratory motion with respect to the base;

a vibratory drive operatively coupled to the vibratory frame for imparting vibratory motion generally contained within a plane to the vibratory frame;

a screen assembly including a screen mounted to a peripheral and generally rectangular screen frame, the screen assembly being selectively coupled to the vibratory frame so that the vibratory motion is transmitted to the screen assembly; and a screen assembly mounting structure including a first mount on a first end of the screen frame and a second mount on a second end of the screen frame opposite from the first end, each of the mounts projecting from a perimeter of the screen frame and being positioned between a portion of the screen frame and a portion of the vibratory frame and being compressible to form a compression fit between the screen frame and the vibratory frame;

wherein the first mount comprises a roller mounted on the screen frame for rotation about an axis generally parallel to the plane and the second mount is fixed and both the roller and the second mount are compressible during installation of the screen assembly to the vibratory frame.

11. The screening machine of claim 10 further comprising:

a plurality of rollers similar to the first mount and being spaced from each other; and a plurality of fixed mounts similar to the second mount and being spaced from each other.

12. The screening machine of claim 10 wherein the respective positions of the roller and of the second mount are adjustable relative to the screen frame prior to installation of the screen assembly to the vibratory frame.

13. A screening machine comprising:

a base;

a vibratory frame mounted to the base for vibratory motion with respect to the base;

a vibratory drive operatively coupled to the vibratory frame for imparting vibratory motion generally contained within a plane to the vibratory frame;

a screen assembly being coupled to the vibratory frame so that the vibratory motion is transmitted to the screen assembly;

a cover;

a plurality of clamps releasably securing the cover to the vibratory frame; and a cover mounting structure including a first mount on a first end of the cover and a second mount on a second end of the cover opposite from the first end, each of the mounts projecting from a perimeter of the cover and being positioned between a portion of the cover and a portion of the vibratory frame and being compressible to form a compression fit between the cover and the vibratory frame;

wherein the first mount comprises a roller mounted on the cover for rotation about an axis generally parallel to the plane and the second mount is fixed and both the roller and the second mount are compressible during installation of the cover to the vibratory frame.

14. A screening machine comprising:

a base;

a vibratory frame mounted to the base for vibratory motion with respect to the base;

a vibratory drive operatively coupled to the vibratory frame for imparting vibratory motion generally contained within a plane to the vibratory frame;

a screening machine component being selectively coupled to the vibratory frame so that the vibratory motion is transmitted to the screening machine component; and a screening machine component mounting structure including a first mount proximate a first end of the screening machine component and a second mount proximate a second end of the screening machine component opposite from the first end, each of the mounts being positioned between a portion of the screening machine component and a portion of the vibratory frame and at least one of the first and second mounts including a rotational element with an axis of rotation generally parallel to the plane to reduce frictional interference between the screening machine component and the vibratory frame during installation of the screening machine component.

15. The screening machine of claim 14 wherein the rotational element is a compressible roller mounted to the screen frame.

16. A mounting structure for releasably securing a screen frame having a screen into a vibratory frame and transmitting vibratory motion of the vibratory frame to the screen frame and the screen, the mounting structure comprising:

a first mount proximate a first end of the screen assembly; and a second mount proximate a second end of the screen assembly opposite from the first end, each of the mounts being positioned between a portion of the screen frame and a portion of the vibratory frame and at least one of the first and second mounts being compressible to form a compression fit between the screen frame and the vibratory frame;

wherein the first and second mounts are mounted to the screen frame and one of the mounts comprises a roller mounted for rotation on the screen frame, the roller being rotatable about an axis generally parallel to a plane containing the vibratory motion of the screen frame and the roller being compressible during installation of the screen assembly to the vibratory frame.

17. The mounting structure of claim 16 further comprising:

a third mount mounted on the first end of the screen frame and spaced from the first mount and a fourth mount mounted on the second end of the screen frame and spaced from the second mount.

18. The mounting structure of claim 16 wherein both the first and second mounts are compressible and comprise a polymeric material.

19. The mounting structure of claim 18 wherein the first mount comprises a roller mounted for rotation on the screen frame and the second mount being fixed, the roller being rotatable and both the roller and the second mount being compressible during installation of the screen assembly to the vibratory frame.

20. The mounting structure of claim 19 wherein the respective positions of the roller and of the second mount are adjustable relative to the screen frame prior to installation of the screen assembly to the vibratory frame.

21. The mounting structure of claim 16 wherein the first and second mounts are mounted to the vibratory frame.

22. A mounting structure for releasably securing a screen frame having a screen into a vibratory frame and transmitting vibratory motion contained within a plane of the vibratory frame to the screen frame and the screen, the mounting structure comprising:

a first mount proximate a first end of the screen assembly;

a second mount proximate a second end of the screen assembly opposite from the first end, each of the mounts being positioned between a portion of the screen frame and a portion of the vibratory frame;

wherein one of the mounts comprises a rotational element with an axis of rotation generally parallel to the plane to reduce frictional interference between the screen frame and the vibratory frame during installation of the screen frame.

23. A screen assembly for a screening machine, the screen assembly being releasably secured into a vibratory frame for transmitting vibratory motion of the vibratory frame to the screen assembly, the screen assembly comprising:

a peripheral screen frame;

a screen mounted to the screen frame; and a mounting structure including a first mount mounted to a first end of the screen frame and a second mount mounted to a second end of the screen frame opposite from the first end, each of the mounts being positioned between a portion of the screen frame and a portion of the vibratory frame and at least one of the first and second mounts being compressible to form a compression fit between the screen frame and the vibratory framer;

wherein the compressible mount comprises a roller mounted on the screen frame for rotation about an axis generally parallel to a plane containing the vibratory motion of the screen frame, the roller being rotatable and compressible during installation of the screen assembly to the vibratory frame.

24. The screen assembly of claim 23 wherein the screen frame is generally rectangular, the mounting structure further comprising:

a third mount mounted on the first end of the screen frame and spaced from the first mount and a fourth mount mounted on the second end of the screen frame and spaced from the second mount.

25. The screen assembly of claim 23 wherein both the first and second mounts are compressible and comprise a polymeric material.

26. The screen assembly of claim 23 wherein a portion of the roller projects from a perimeter of the screen frame.

27. A screen assembly for a screening machine, the screen assembly being releasably secured into a vibratory frame for transmitting vibratory motion of the vibratory frame to the screen assembly, the screen assembly comprising:

a peripheral screen frame;

a screen mounted to the screen frame; and a mounting structure including a first mount mounted to a first end of the screen frame and a second mount mounted to a second end of the screen frame opposite from the first end, each of the mounts being positioned between a portion of the screen frame and a portion of the vibratory frame and at least one of the first and second mounts being compressible to form a compression fit between the screen frame and the vibratory frame;

wherein the first mount comprises a roller mounted for rotation on the screen frame and the second mount being fixed, the roller being rotatable and both the roller and the second mount being compressible during installation of the screen assembly to the vibratory frame.

28. The screen assembly of claim 27 wherein the respective positions of the roller and of the second mount are adjustable relative to the screen frame prior to installation of the screen assembly to the vibratory frame.

29. A screen assembly for a screening machine, the screen assembly being releasably secured into a vibratory frame for transmitting vibratory motion of the vibratory frame to the screen assembly, the screen assembly comprising:

a generally rectangular screen frame;

a screen mounted to the screen frame; and a mounting structure including a first mount on a first end of the screen frame and a second mount on a second end of the screen frame opposite from the first end, each of the mounts projecting from a perimeter of the screen frame and being positioned between a portion of the screen frame and a portion of the vibratory frame and being compressible to form a compression fit between the screen frame and the vibratory frame;

wherein the first mount comprises a roller mounted for rotation on the screen frame and the second mount is fixed and both the roller and the second mount are compressible during installation of the screen assembly to the vibratory frame.

30. The screen assembly of claim 29 further comprising:

a plurality of rollers similar to the first mount and being spaced from each other on the first end of the screen frame; and a plurality of fixed mounts similar to the second mount and being spaced from each other on the second end of the screen frame.

31. The screen assembly of claim 29 wherein the respective positions of the roller and of the second mount are adjustable relative to the screen frame prior to installation of the screen assembly to the vibratory frame.

32. A screen assembly for a screening machine, the screen assembly being releasably secured into a vibratory frame for transmitting vibratory motion within a plane to the screen assembly, the screen assembly comprising:

a generally rectangular screen frame;

a screen mounted to the screen frame; and a mounting structure including a first mount on a first end of the screen frame and a second mount on a second end of the screen frame opposite from the first end, each of the mounts projecting from a perimeter of the screen frame and being positioned between a portion of the screen frame and a portion of the vibratory frame and being compressible to form a compression fit between the screen frame and the vibratory frame;

wherein the first mount comprises a roller mounted for rotation on the screen frame about an axis generally parallel to the plane and the second mount is fixed and both the roller and the second mount are compressible during installation of the screen assembly to the vibratory frame.

33. The screen assembly of claim 32 further comprising:

a plurality of rollers similar to the first mount and being spaced from each other on the first end of the screen frame; and a plurality of fixed mounts similar to the second mount and being spaced from each other on the second end of the screen frame.

34. The screen assembly of claim 32 wherein the respective positions of the roller and of the second mount are adjustable relative to the screen frame prior to installation of the screen assembly to the vibratory frame.

35. A mounting structure for releasably securing a cover onto a vibratory frame selectively experiencing vibratory motion generally within a plane, the mounting structure comprising:

a first mount proximate a first end of the cover, the first mount being a roller mounted for rotation about an axis generally parallel to the plane; and a second mount proximate a second end of the cover opposite from the first end, each of the mounts being positioned between a portion of the top cover and a portion of the vibratory frame and at least one of the first and second mounts being compressible to form a compression fit between the cover and the vibratory frame.

* * * * *

UNITED STATES PATENT AND TRADEMARK OFFICE

CERTIFICATE OF CORRECTION

PATENT NO. : 6,053,329

DATED : April 25, 2000

INVENTOR(S) : Brady P. Ballman

It is certified that error appears in the above-indentified patent and that said Letters Patent is hereby corrected as shown below:

Column 9, Line 12, "base:" should read --base;--.

Column 12, Line 4, "framer" should read --frame--.

Signed and Sealed this

Twenty-fourth Day of April, 2001

*Attest:*

Nicholas P. Godici

NICHOLAS P. GODICI

*Attesting Officer*

*Acting Director of the United States Patent and Trademark Office*